US008695755B2

(12) United States Patent
Mihaly

(10) Patent No.: US 8,695,755 B2
(45) Date of Patent: Apr. 15, 2014

(54) POP UP CURTAIN ASSEMBLY

(75) Inventor: Orestes Mihaly, New Windsor, NY (US)

(73) Assignee: Production Resource Group, L.L.C., New Windsor, NY (US)

( * ) Notice: Subject to any disclaimer, the term of this patent is extended or adjusted under 35 U.S.C. 154(b) by 0 days.

(21) Appl. No.: 13/346,839

(22) Filed: Jan. 10, 2012

(65) Prior Publication Data

US 2013/0192922 A1 Aug. 1, 2013

Related U.S. Application Data

(60) Provisional application No. 61/431,782, filed on Jan. 11, 2011.

(51) Int. Cl.
*E04B 1/344* (2006.01)
*E04B 1/343* (2006.01)
*A47G 5/00* (2006.01)

(52) U.S. Cl.
USPC ..... 181/287; 160/135; 160/351; 160/84.09

(58) Field of Classification Search
USPC ..... 181/287, 284, 30; 52/144, 145; 160/32, 160/35, 84.01, 84.09, 199, 405, 135, 351, 160/222, 185, 377, 379
See application file for complete search history.

(56) References Cited

U.S. PATENT DOCUMENTS 684,130 A * 10/1901 Taubert ..... 160/84.09
730,677 A * 6/1903 Marcus ..... 405/288
1,688,010 A * 10/1928 Godske ..... 248/278.1
1,800,627 A * 4/1931 Heck ..... 160/24
2,120,979 A * 6/1938 Hunt ..... 181/30
2,395,303 A * 2/1946 Stableford ..... 160/24
2,479,812 A * 8/1949 Cechmanek ..... 160/24
3,007,539 A * 11/1961 Brewer et al. ..... 52/144
3,592,255 A * 7/1971 Potter et al. ..... 160/24
4,039,021 A * 8/1977 Moritz et al. ..... 160/202
4,068,921 A * 1/1978 Okumura ..... 359/461
4,083,395 A * 4/1978 Romano ..... 160/199
4,286,343 A * 9/1981 Lampka ..... 4/596
4,444,240 A * 4/1984 Bannister ..... 160/135
5,403,979 A * 4/1995 Rogers et al. ..... 181/30
5,651,405 A * 7/1997 Boeddeker et al. ..... 160/135
5,653,278 A * 8/1997 Cheng ..... 160/370.22
5,706,130 A * 1/1998 Rosen ..... 359/443
5,752,560 A * 5/1998 Cherng ..... 160/370.22
5,896,910 A * 4/1999 Chen ..... 160/370.22
6,085,861 A * 7/2000 Jines ..... 181/30
6,216,762 B1 * 4/2001 Lin ..... 160/370.22
6,249,377 B1 * 6/2001 Takamoto et al. ..... 359/461
6,297,905 B1 * 10/2001 Takamoto et al. ..... 359/461
6,457,508 B1 * 10/2002 Tomita ..... 160/67
6,630,222 B1 * 10/2003 Fay et al. ..... 428/118
6,763,874 B1 * 7/2004 Chen ..... 160/370.22
6,834,705 B2 * 12/2004 Seel ..... 160/370.22
7,455,345 B1 * 11/2008 Kim ..... 296/97.4
7,600,608 B2 * 10/2009 Freiheit ..... 181/287
7,821,709 B2 * 10/2010 Anderson et al. ..... 359/443
7,864,418 B2 * 1/2011 Kuroi et al. ..... 359/443
8,091,605 B1 * 1/2012 Melhart ..... 160/135
8,184,369 B2 * 5/2012 Kuroi ..... 359/461
8,274,737 B2 * 9/2012 Wang ..... 359/461

* cited by examiner

*Primary Examiner* — Edgardo San Martin
(74) *Attorney, Agent, or Firm* — Law Office of Scott C. Harris, Inc.

(57) ABSTRACT

A pop up device for a curtain, that is compressed to be packaged in a box, and expanded out of said box.

16 Claims, 6 Drawing Sheets

POP UP CURTAIN ASSEMBLY

This application claims priority from provisional application number 61/431,782, filed Jan. 11, 2011, the entire contents of which are herewith Incorporated by reference.

BACKGROUND

Acoustic barriers are often used for various purposes including blocking the sound from sound producing devices in a performance environment (such as on a stage). The acoustic barriers may be permanent or movable.

A portable acoustic barrier can be used for various functions including for example in an orchestra to block louder players such as the drummer, to reduce the sound created by the drummer. This can be used for example in a garage for forming a portable recording studio. Portable acoustic barriers can be used for many other purposes.

SUMMARY

The present application rates relates to a raisable and lowerable acoustic curtain. The curtain is made of acoustic attenuating material. In one embodiment, the curtain can be raised in order to create, for example, a portable sound deadening drape.

According to an embodiment, the sound deadening barrier can be stored in a space reduced state inside a box. For example this may facilitate the transport of the sound deadening barrier, since a smaller box can be more easily transported than the extended device. The box can unfold to make it drape that can be raised in order to use sound deadening material in any desired location. For example, a user can open the lid, pull up the drape, and form a curtain of sound deadening drapery material.

In embodiments, springs are provided to bias the unfolded sound deadening barrier towards its uppermost (deployed) position. The legs can also lock into place in the uppermost position.

DETAILED DESCRIPTION

Figures 1, 2:
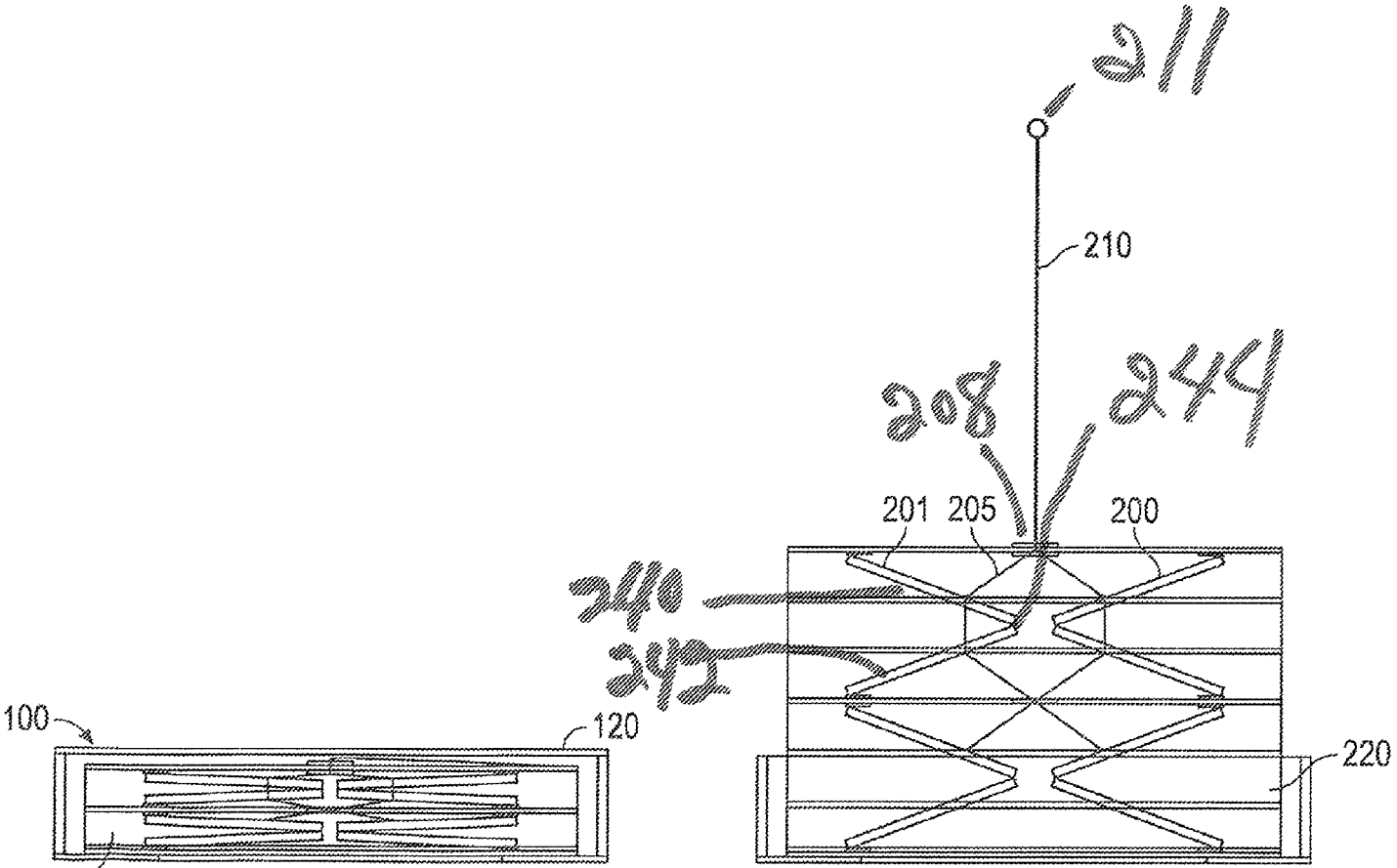
FIG. 1 shows an embodiment of the sound deadening material in its fully compressed and stowed position inside a box.
FIG. 2 shows a beginning portion of unfolding the sound deadening material.

FIG. 1 illustrates the basic device according to an embodiment. The box 100 forms a holding area for the folded acoustic curtain device 110 inside the box. The box also has a cover 120 which is hinged relative to a bottom portion of the box to open and close the box to allow the acoustic curtain therein to be folded and unfolded.

The curtain itself can be formed of any acoustic deadening or attenuating material, which may be made of vinyl, cotton, wool or any other material. For example, 10 ounce or 18 ounce cotton draperies can be used.

FIG. 1 illustrates the device in its completely folded condition in which the drapery material is folded in a zigzag or accordion shape with each leg moving in an opposite angular direction to each adjacent leg. As explained herein, the accordion legs each pivot with respect to one another, and there are also springs (shown in detail in FIGS. 9-10) that bias the legs towards their open/extended position.

Figure 10:
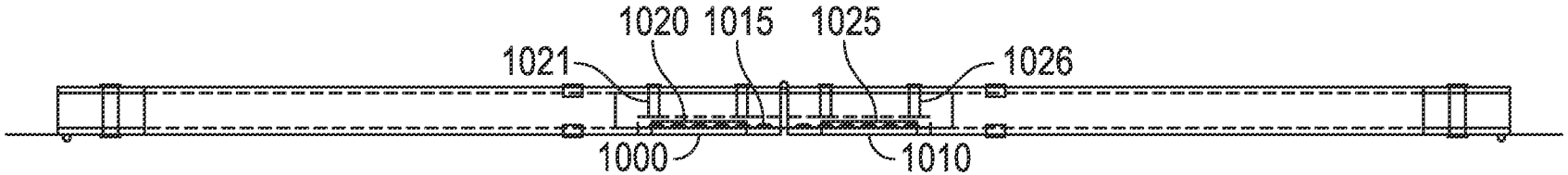

Each leg assembly such as 201 includes a first leg piece 240 connected to a second leg piece 242 via a hinge 244 that includes an extension spring thereon, shown in further detail in FIG. 10. The extension spring is biased into the open most position, that is the extension spring is under its minimum tension thereon when the legs 240, 242 form straight lines relative to one another, e.g., into the position shown in FIG. 4.

Each interface between each two legs includes such a hinge and extension spring thereon, thus biasing the device toward its open most position.

In operation, there is a pull string shown as 210 attached to the top support surface 208.

The unfolding operation starts by pulling up against the device slightly against the force of the springs. The pulling can be done by pulling on the cable 210 which pulls up the top support 208, and releases any closing lock on the legs, if there is one. The springs, once released, assist the process of unfolding the accordion legs 200, 201, and raising the curtain.

Either each, or a number of, the accordion shaped legs is also connected to release string 205 which in turn connects to release pull 210. The release pull 210 may be up 1/16 inch coated wire rope with a release cable and with a finger pull 211.

Figure 4:
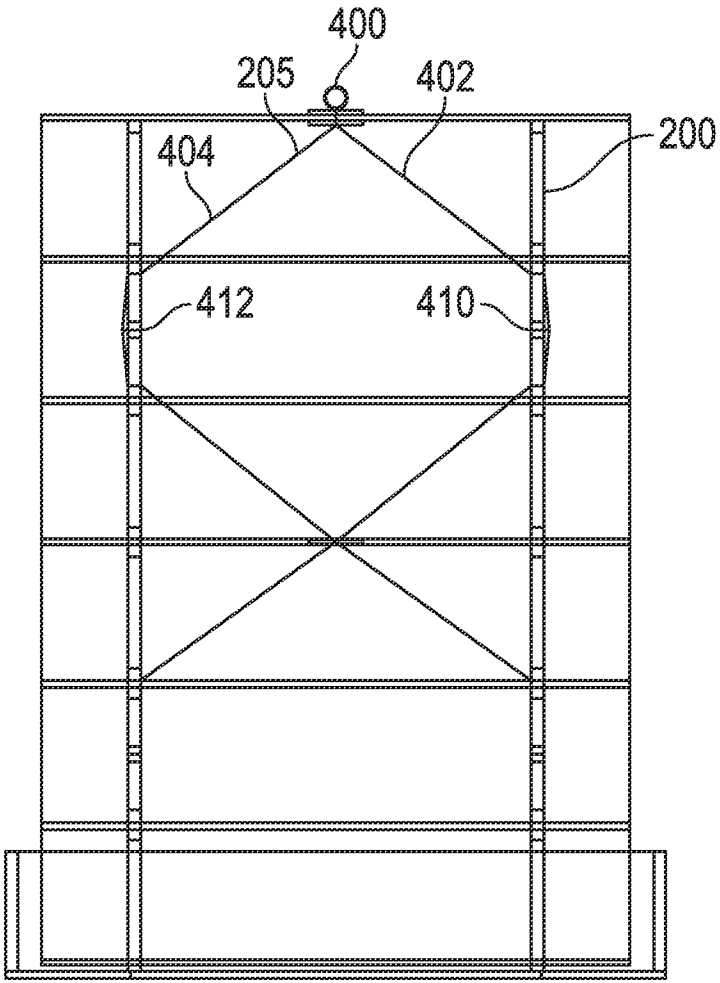
FIG. 4 shows the sound deadening material in its fully extended portion with its legs locked.

The accordion legs 200, 201 are spring biased into their open most position (as shown in FIG. 4) by the springs, so that the springs assist the opening. The springs may be biased such that once the device is in a high enough position such as in FIG. 2 (e.g, more than half way fully extended), it will automatically raise the rest of the way based on the spring force.

The ribs 220 can be supports that support the structure of the device and also may hold the drape of material.

Figure 3:
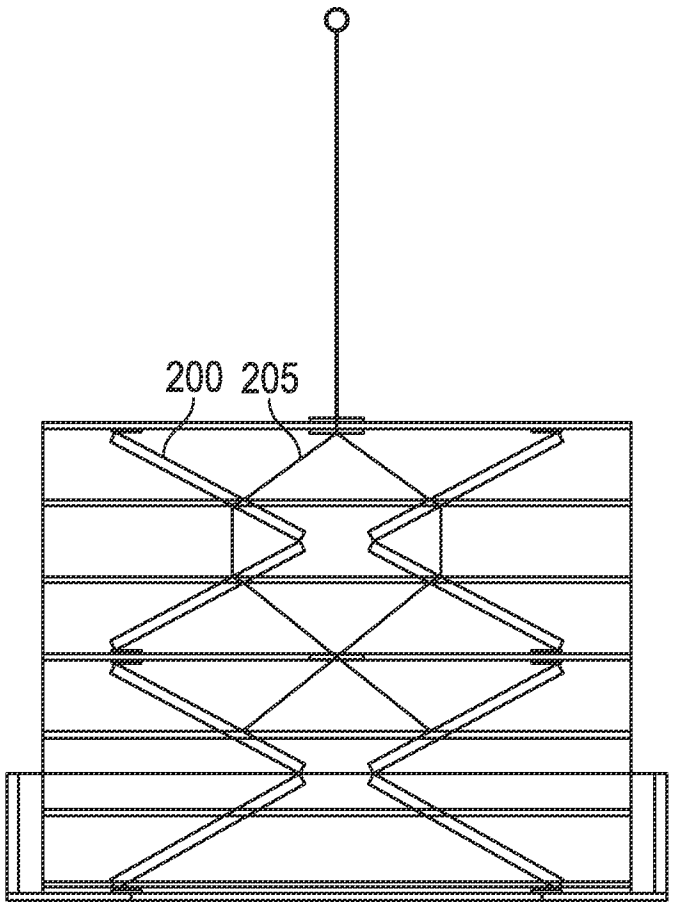
FIG. 3 shows a second step along the way of of unfolding the sound deadening materials.

As the device opens, it progresses to the position shown in FIG. 3 where it is more open than the position shown in FIG. 2. FIG. 3 shows the next step with the device open more than halfway. At this point, the accordion legs such as 240, 242 are biasing into their straight position.

The springs are finally in their most relaxed and stable position when each of the legs 200 is in a substantially vertical position as in FIG. 4. FIG. 4 shows the drape device completely extended and locked into position by spring locks 410, 412. Note that the string 205 is fully inside the unit in the FIG. 4 position.

Once the device is fully open, it is in the position shown in FIG. 4 where it is most open, and is locked into place and there is a minimum tension on the springs. Thereafter, pulling on the pull release 211 correspondingly pulls on the strings 205, 402 and allows/assists in collapsing the device against the force of the springs.

Release cable end 400 is pulled to pull the release parts 402, 404, thereby releasing locks such as 410, 412, allowing the device to be closed. In one embodiment, there are only two such locks shown as 410 412, or there can be corresponding locks at all or some of the hinges in other embodiments. Pulling on the release string 402 releases the locks allowing closing the device against the force of the spring, and placing it back into the box.

When fully extended in an embodiment, the drape can be approximately 6 feet tall. In different embodiments, there can be different heights. There can also be casters on the bottom of the device, or foldout legs that assist in the stability.

Figure 5A:
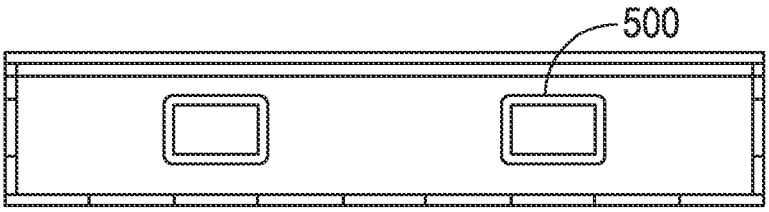
FIGS. 5A and 5B show respective sides of the case holding the sound deadening materials.
Figure 5B:
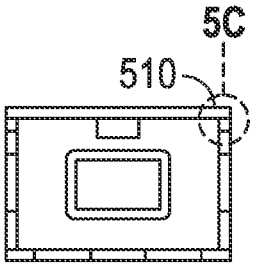
Figure 5C:
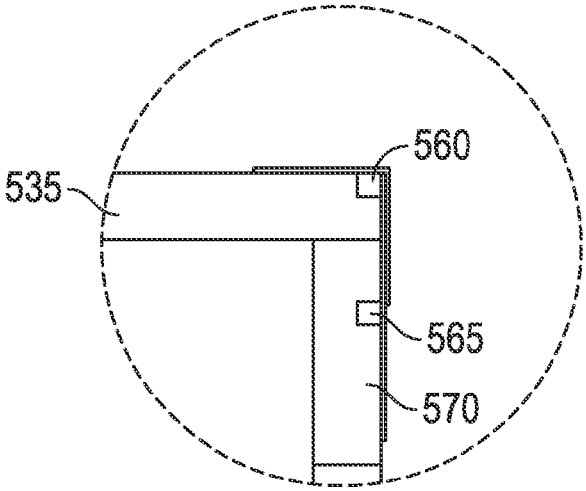
FIG. 5C shows a view of the inside of the box.

FIGS. 5A and 5B show the box itself, having recessed handles 500 both in the long and short dimensions of the box. The box also includes a custom double hinge 510 which is shown in further detail in FIG. 5C. The custom double hinge is a 2×3 piano hinge welded together, and screwed to the box lid 550 and also to the back 555 of the box. The double hinge 610 allows the lid to fold back completely on its side when opened. When closed, the lid is in the position shown in FIG. 5C, and when opened, the hinge can hinge in two different places, both at the hinging point 560 and also at the hinging point 570 to allow the lid to fall back on itself when open.

Figure 6A:
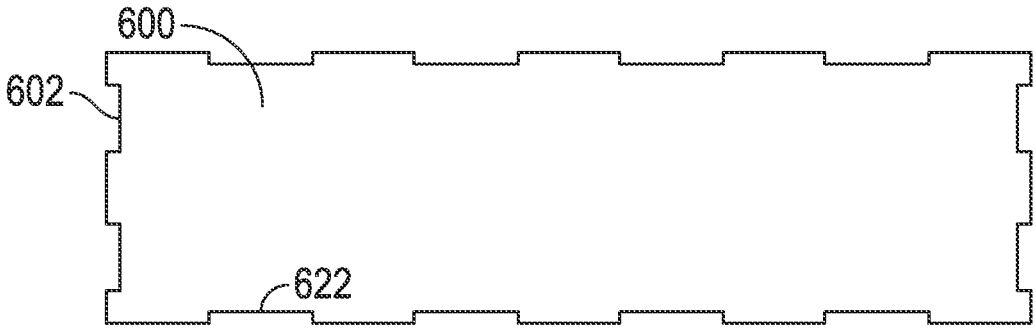
FIGS. 6A, 6B, 6C show the structure making up the box.
Figure 6B:
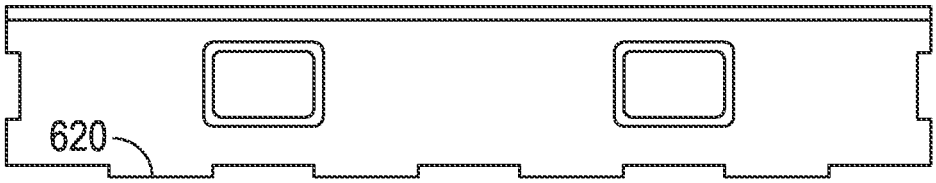
Figure 6C:
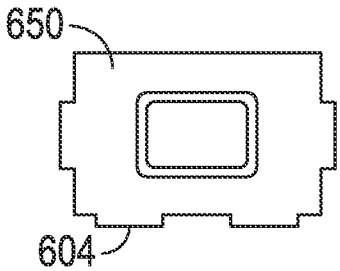

Assembly drawings of the box parts, including sides and bottom, are as shown in FIGS. 6A, 6B and 6C. The box may be formed of a number of parts having interlocking portions so that the bottom of the box 600 shown in FIG. 6A has interlocking portions such as 602. These portions may interlock with corresponding portions in the side of the box so that the portion 602 mates with the portion 604 on the box side 650 shown in FIG. 6C. Similarly, the side portions of the box have portions such as 620 which mate with the corresponding bottom portion 622. The box can be assembled together out of plywood, for example, and glued together in this way.

Figure 7:
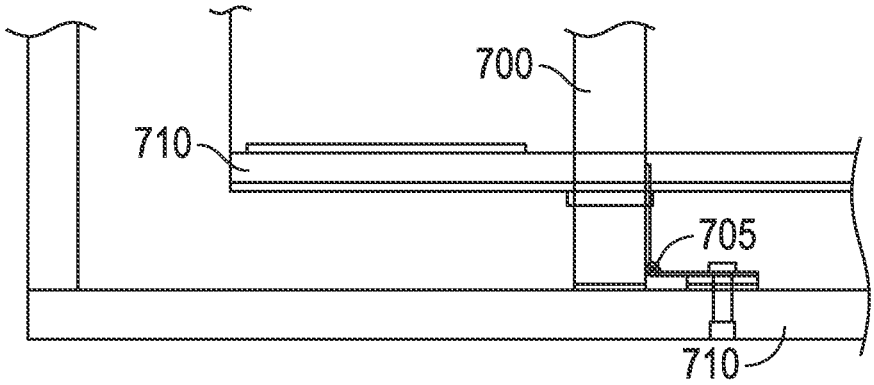
FIGS. 7 and 8 show the cross hinges.

FIG. 7 shows details of the connection of the hinges to the accordion legs. The accordion shaped legs are shown as 700, and in FIG. 7, are shown in the upright position. The leg 700 is attached via a hinge 705 to the bottommost portion 708 of the box on a connection socket 715. A 3/16×1×1 shim 716 may hold the hinge above the bottommost portion of the box allowing more movement of the leg. The hinged leg 700 can then therefore move up and down. Acoustic floats 710 correspond to the ribs 220 as shown in FIG. 2, and may have different portions of acoustic material attached to them in a way that allows the acoustic material to fold and re-extend as necessary.

Figure 8:
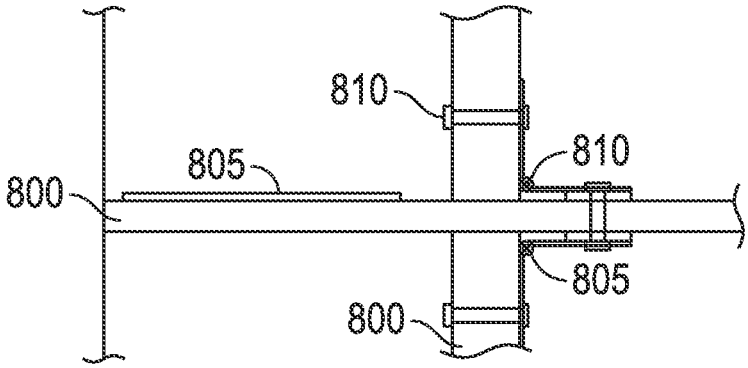

FIG. 7 shows the bottommost connection of the supports to the box. FIG. 8 shows the connections of the legs at their middle portions.

The float 800 has an acoustic clip 805 that clips to the acoustic material. The legs 802 may be any of the accordion shaped legs such as 200 shown in FIGS. 1-4.

The legs 802 are formed with double hinges, including a first hinge 805 on its bottom portion and a second hinge 810 on its top portion. The hinges are attached to the legs by tamper-resistant blind rivets 811.

Figure 9:
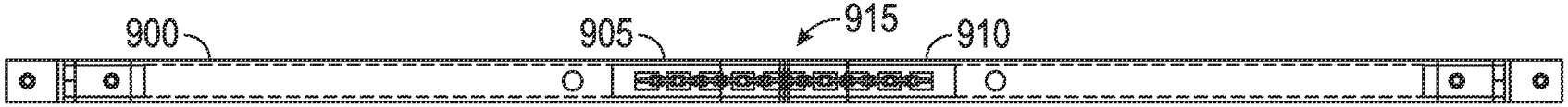
FIGS. 9 and 10 shows the hinged leg assembly.

FIGS. 9 and 10 show alternate views of the leg assemblies. Each leg assembly such as 900 is formed from first and second leg segments 905, 910. The leg segments are hinged together at the pivot 915. Each of the legs is held by a pivot side. Springs, shown as 1000, 1010, hold together the legs and bias them into the open position.

FIG. 10 shows the side view of the legs, showing the hinge 915 from the side. Spring 1000 is connected by a connection bolt 1021 to the leg segment 905 at one end, and the other end 1022 is connected to the chain 1015. Analogously, the spring 1010 is connected by a connection bolt 1026 to the leg segment 910 at one end, and the other end is connected to the other end of the chain 1015. Thus, the extension springs connect between the pair of legs, and bias the two legs into the extended position as shown in FIG. 10.

FIG. 10 shows the two half legs 905, 910 being at 180° relative to one another. In this position, the springs 1020, 1025 are at their maximum relaxed position. The springs are attached to the respective attachment mechanisms with spring 1020 attached to mechanism 1021 and spring 1025 attached to mechanism 1026.

As the two leg segments 905, 910 move towards one another in the direction of the arrows shown in FIG. 10, this causes a lengthening of the distance between 1021 and 1026 and a corresponding increase in the tension on the extension springs on the leg segments. Accordingly, the leg segments are biased into the position shown in FIG. 10. While they can be stored in the compressed position, the springs are under maximum tension in that position.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art. For example other configurations for other applications are possible. Other kinds of springs and other kinds of legs can be used. Locks can be used to hold the legs and open and/or close positions, or the force or spring force can be used.

Also, the inventor intends that only those claims which use the words "means for" are intended to be interpreted under 35 USC 112, sixth paragraph. Moreover, no limitations from the specification are intended to be read into any claims, unless those limitations are expressly included in the claims. The computers described herein may be any kind of computer, either general purpose, or some specific purpose computer such as a workstation. The programs may be written in C, or Java, Brew or any other programming language. The programs may be resident on a storage medium, e.g., magnetic or optical, e.g. the computer hard drive, a removable disk or media such as a memory stick or SD media, or other removable medium. The programs may also be run over a network, for example, with a server or other machine sending signals to the local machine, which allows the local machine to carry out the operations described herein.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A pop up device for forming a curtain, comprising:

a box, having an inside portion; and an extendable assembly, having a connection part that is connected to the box, and having an extending part that in a retracted position where said extendable assembly fits completely within the box, and said extendable assembly extends to an extended height that extends above the box, wherein said extendable assembly includes first and second legs which fold to said retracted position, and extend relative to said box between said retracted position where said first and second legs fit inside the box, and a fully extended portion where said first and second legs are fully extended where they are at a fully extended height, and a spring that spring biases said first and second legs into said fully extended position, and where at said fully extended height, said springs have minimum tension, thereby assisting extending to said fully extended position, said extendable assembly including crosswise ribs extending between said first and second legs at multiple locations between said first and second legs, said crosswise ribs including clips thereon and holding a sound deadening material.

2. The device as in claim 1, wherein said sound deadening material is at least 10 ounce draperies or thicker which forms an acoustic curtain in said upright position, and folds to fit fully within the box in said retracted position.

3. The device as in claim 2, wherein said legs lock in at least one position, and further comprising at least one pull string which unlocks the legs from their locked and fully closed position.

4. The device as in claim 2, wherein said legs are each formed of multiple leg segments, each leg segment which hinges at opposite ends thereof, and where said hinges causes said leg segments to fold relative to one another with each leg moving in an opposite angular direction to each adjacent leg.

5. The device as in claim 2, further comprising a top to the box, which closes to hold said extendable assembly therein, fitting completely within the box in said retracted position.

6. The device as in claim 5, wherein the top to the box is hinged at two different locations, allowing the box to open including both the top of the box, and a portion of a side of the box.

7. A method of temporarily acoustically shielding an area, comprising:

storing an acoustic curtain in a folded position inside a box, said acoustic curtain made of a sound deadening material;

extending said assembly by pulling an a release holder, and pulling said assembly to a first height using said release holder;

wherein said pulling on said release holder causes first and second folded legs to unfold from said retracted position, and to extend relative to one another from said retracted position where said first and second legs fit inside the box, to said first height;

whereby a spring bias on said legs causes said legs to automatically extend to a fully extended portion where said first and second legs are at a fully extended height after reaching said first height, and where at said fully extended position, said spring bias has minimum tension, thereby assisting extending to said fully extended position, wherein said acoustic curtain is connected to crosswise ribs extending between said first and second legs at multiple locations between said first and second legs; and when in said extended position, using said acoustic curtain for carrying out an acoustic shield.

8. The method as in claim 7, wherein said legs lock in at least one position which is a fully retracted position, and further comprising at least unlocking the legs from their locked position using said release holder.

9. The method as in claim 7, wherein said legs are each formed of multiple leg segments, each leg segment which hinge at opposite ends thereof, and where said extending comprises unfolding said leg segments relative to one another with each leg moving in an opposite angular direction to each adjacent leg.

10. The method as in claim 7, further comprising using a top to the box to close the box with said acoustic curtain therein, fitting completely within the box in said retracted position.

11. The method as in claim 10, wherein the top to the box is hinged at two different locations, allowing the box to open including both the top of the box, and a portion of a side of the box.

12. The device as in claim 3, wherein said pull string extends outside a perimeter of the acoustic curtain when the extendable assembly is in the retracted position, and said pull string fully within the inside of the perimeter of the acoustic curtain when the extendable assembly is in the extended position.

13. The device as in claim 1, wherein the springs are biased to automatically extend the extendable assembly into the fully extended position once the extendable assembly has been manually brought to halfway extended.

14. The method as in claim 10, further comprising locking said legs in a closed position, and further comprising using at least one pull string which unlocks the legs from said closed for extending said box, said pull string extends outside a perimeter of the acoustic curtain in the retracted position, and is held within the inside of the perimeter of the acoustic curtain in the extended position.

15. The method as in claim 10, wherein the springs are biased to automatically extend the assembly into the fully extended position once the assembly has been manually brought to halfway extended.

16. The method as in claim 10, wherein said sound deadening material is at least 10 ounce draperies or thicker, which forms an acoustic curtain in said upright position, and folds to fit fully within the box in said retracted position.

* * * * *